US006679270B2

(12) United States Patent
Baskevitch et al.

(10) Patent No.: US 6,679,270 B2
(45) Date of Patent: Jan. 20, 2004

(54) REDUCTION OF NITROSAMINES IN TOBACCO AND TOBACCO PRODUCTS

(76) Inventors: Nicolas Baskevitch, 11870 N. Hickory Trace, Alpharetta, GA (US) 30004; Lanig Le Bec, 11, rue de Torce, Le Mans 72000 (FR); Diane Raverdy-Lambert, 48 rue Scarron, Le Mans 72000 (FR)

( * ) Notice: Subject to any disclaimer, the term of this patent is extended or adjusted under 35 U.S.C. 154(b) by 0 days.

(21) Appl. No.: 09/971,091

(22) Filed: Oct. 3, 2001

(65) Prior Publication Data

US 2002/0134394 A1 Sep. 26, 2002

Related U.S. Application Data

(60) Provisional application No. 60/238,248, filed on Oct. 5, 2000.

(51) Int. Cl.[7] ..... A24B 15/24; A24B 1/02

(52) U.S. Cl. ..... 131/297; 131/298; 131/300; 131/309; 131/310; 131/370

(58) Field of Search ..... 131/297, 298, 131/370, 372, 300, 309, 310

(56) References Cited

U.S. PATENT DOCUMENTS

| | | | | |
|---|---|---|---|---|
| 3,353,541 | A | | 11/1967 | Hind et al. |
| 3,386,449 | A | | 6/1968 | Hind |
| 3,415,253 | A | | 12/1968 | Michels et al. |
| 3,420,241 | A | | 1/1969 | Hind et al. |
| 3,428,053 | A | | 2/1969 | Schoenbaum et al. |
| 3,467,109 | A | | 9/1969 | Block et al. |
| 3,483,874 | A | | 12/1969 | Hind |
| 3,561,451 | A | | 2/1971 | Jacin et al. |
| 3,760,815 | A | | 9/1973 | Deszyck |
| 3,805,803 | A | | 4/1974 | Hedge et al. |
| 3,847,164 | A | | 11/1974 | Mattina et al. |
| 3,860,012 | A | | 1/1975 | Selke |
| 4,182,349 | A | | 1/1980 | Selke |
| 4,256,123 | A | | 3/1981 | Lendvay et al. |
| 4,256,126 | A | | 3/1981 | Seligman et al. |
| 4,674,519 | A | | 6/1987 | Keritsis et al. |
| 4,730,629 | A | | 3/1988 | Graves, Jr. et al. |
| 4,966,169 | A | | 10/1990 | Waddell et al. |
| 5,016,655 | A | | 5/1991 | Waddell et al. |
| 5,119,835 | A | * | 6/1992 | Heemann et al. ..... 131/297 |
| 5,137,034 | A | * | 8/1992 | Perfetti et al. ..... 131/194 |
| 5,148,819 | A | | 9/1992 | Fagg |
| 5,230,354 | A | | 7/1993 | Smith et al. |
| 5,234,008 | A | | 8/1993 | Fagg |
| 5,243,999 | A | | 9/1993 | Smith |
| 5,311,886 | A | | 5/1994 | De Grandpré et al. |
| 5,575,302 | A | | 11/1996 | Blöcker et al. |
| 5,584,989 | A | | 12/1996 | Jameson |
| 5,601,097 | A | | 2/1997 | De Grandpré et al. |
| 5,715,844 | A | | 2/1998 | Young et al. |
| 5,724,998 | A | | 3/1998 | Gellatly et al. |
| 5,765,570 | A | | 6/1998 | Litzinger et al. |
| 5,810,020 | A | | 9/1998 | Northway et al. |
| 5,829,453 | A | | 11/1998 | White et al. |
| 6,058,940 | A | | 5/2000 | Lane |
| 6,298,859 | B1 | * | 10/2001 | Kierulff et al. ..... 131/297 |
| 2002/0148478 | A1 | * | 10/2002 | Pera ..... 131/341 |

FOREIGN PATENT DOCUMENTS

| | | | |
|---|---|---|---|
| EP | 0740907 | A1 | 6/1996 |
| WO | WO9938396 | A1 | 8/1999 |
| WO | WO0165954 | A1 | 9/2001 |

OTHER PUBLICATIONS

Significant reduction of carcinogenic compounds in tobacco smoke by the use of zeolite catalysts Aug. 16, 1999.

* cited by examiner

*Primary Examiner*—Dionne A. Walls
(74) *Attorney, Agent, or Firm*—Dority & Manning, P.A.

(57) ABSTRACT

A method for reducing the content of nitrosamines (e.g., N'-Nitrosonornicotine, 4-(Methylnitrosamino)-1-(3-pyridyl)-1-butanone, N'-Nitrosoanatabine, and N'-Nitrosoanabasine) in tobacco is provided. In one embodiment, the method includes combining tobacco with a solvent (e.g., water and/or other compounds) to form a soluble portion. The soluble portion contains an initial total level of tobacco-specific nitrosamines per gram of the soluble portion. The soluble portion is contacted with a nitrosamine-reducing material such that the resulting weight percentage of the tobacco-specific nitrosamines per gram of said soluble portion is at least about 20% less than the initial total level of the tobacco-specific nitrosamines per gram of the soluble portion.

38 Claims, 3 Drawing Sheets

REDUCTION OF NITROSAMINES IN TOBACCO AND TOBACCO PRODUCTS

RELATED APPLICATIONS

The present application claims priority to a provisional application filed on Oct. 5, 2000 having Ser. No. 60/238,248.

BACKGROUND OF THE INVENTION

Smoking articles, (e.g., cigarettes, cigars, pipes, etc) and smokeless tobacco products (e.g., chewing tobacco, snuff, etc.) are made from natural tobacco, reconstituted tobacco, and blends thereof. Reconstituted tobacco is a type of tobacco that is generally manufactured from natural tobacco by-products generated during the threshing of the natural tobacco leaf or during the manufacture of the tobacco article. However, some natural tobaccos, such as dark air cured, air cured, burley tobaccos, etc., may contain nitrosamines formed during the curing of tobacco, e.g., tobacco-specific nitrosamines (TSNAs) and non-tobacco-specific nitrosamines. Likewise, reconstituted tobacco formed from natural tobacco by-products may also contain nitrosamines. In addition, the smoke produced by tobacco products containing nitrosamines can also contain nitrosamines, which are either transferred from tobacco or pyro-synthesized in certain cases.

Extensive research has been conducted on nitrosamines and TSNAs, particularly in tobacco products. In many cases, it has been determined that such ingredients may be unwanted in the final tobacco product. For example, U.S. Pat. No. 5,810,020 to Northway, et al. describes a process for removing TSNAs from tobacco by contacting the tobacco material with a trapping sink, wherein the trapping sink comprises a select transition metal complex which is readily nitrosated to form a nitrosyl complex with little kinetic or thermodynamic hindrance.

Despite such attempted benefits to remove TSNAs from tobacco, a need currently exists for an improved method of reducing the content of nitrosamines (e.g., TSNAs) in tobacco. In particular, a need exists for an effective and relatively inexpensive method for reducing nitrosamines (e.g., TSNAs) in tobacco (e.g., natural tobacco, reconstituted tobacco, tobacco extracts, blends thereof, and other tobacco-containing materials) as well as tobacco products formed therefrom.

SUMMARY OF THE INVENTION

In accordance with one embodiment of the present invention, a method for reducing the content of nitrosamines in tobacco is disclosed. The method includes combining tobacco with a solvent (e.g., water and/or other compounds) to form a soluble portion. The soluble portion contains an initial total level of tobacco-specific nitrosamines per gram of the soluble portion. For instance, in one embodiment, the tobacco-specific nitrosamines are selected from the group consisting of N'-Nitrosonornicotine, 4-(Methylnitrosamino)-1-(3-pyridyl)-1-butanone, N'-Nitrosoanatabine, and N'-Nitrosoanabasine.

Once formed, the soluble portion is contacted with a nitrosamine-reducing material (e.g., adsorbent or absorbent) such that the resulting total level of the tobacco-specific nitrosamines per gram of the soluble portion is at least about 20% less than the initial total level of the tobacco-specific nitrosamines per gram of the soluble portion, and in some embodiments, at least about 60% less than the initial total level of the tobacco-specific nitrosamines, and in some embodiments, between about 85% to about 100% less than the initial total level of the tobacco-specific nitrosamines. For example, in some embodiments, the resulting total level of nitrosamines in the soluble portion is less than about 300 nanograms per gram of the soluble portion, and in some embodiments, less than about 40 nanograms per gram of the soluble portion.

In general, any material capable of reducing the amount of nitrosamines in tobacco can be utilized in the present invention. For instance, in one embodiment, the nitrosamine-reducing material is selected from the group consisting of charcoal, activated charcoal, zeolite, sepiolite, and combinations thereof. Further, the nitrosamine-reducing material may also possess certain characteristics that enhance its ability to remove nitrosamines from the tobacco. For example, in some embodiments, the nitrosamine-reducing material has a surface area greater than about 600 square meters per gram, and in some embodiments, greater than about 1000 square meters per gram. Moreover, in some embodiments, the nitrosamine-reducing material includes pores, channels, or combinations thereof, which have a mean diameter larger than about 3.5 angstroms, and in some embodiments, larger than about 7 angstroms.

The nitrosamine-reducing material can generally be contacted with the soluble portion in any of a variety of different ways. For example, in one embodiment, the nitrosamine-reducing material can be mixed with the soluble portion. If desired, after contacting the soluble portion with the nitrosamine-reducing material, the nitrosamine-reducing material may optionally be removed therefrom.

Besides being capable of reducing the content of nitrosamines in tobacco, it has also been discovered that the nitrosamine-reducing material is capable of reducing the content of alkaloids in the tobacco. For example, in some embodiments, the alkaloids content can be reduced at least about 10%, in some embodiments between about 25% to about 95%, and in some embodiments, between about 60% to about 95% after being contacted with the nitrosamine-reducing material.

Other features and aspects of the present invention are described in more detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

DETAILED DESCRIPTION OF REPRESENTATIVE EMBODIMENTS

Figure 1:
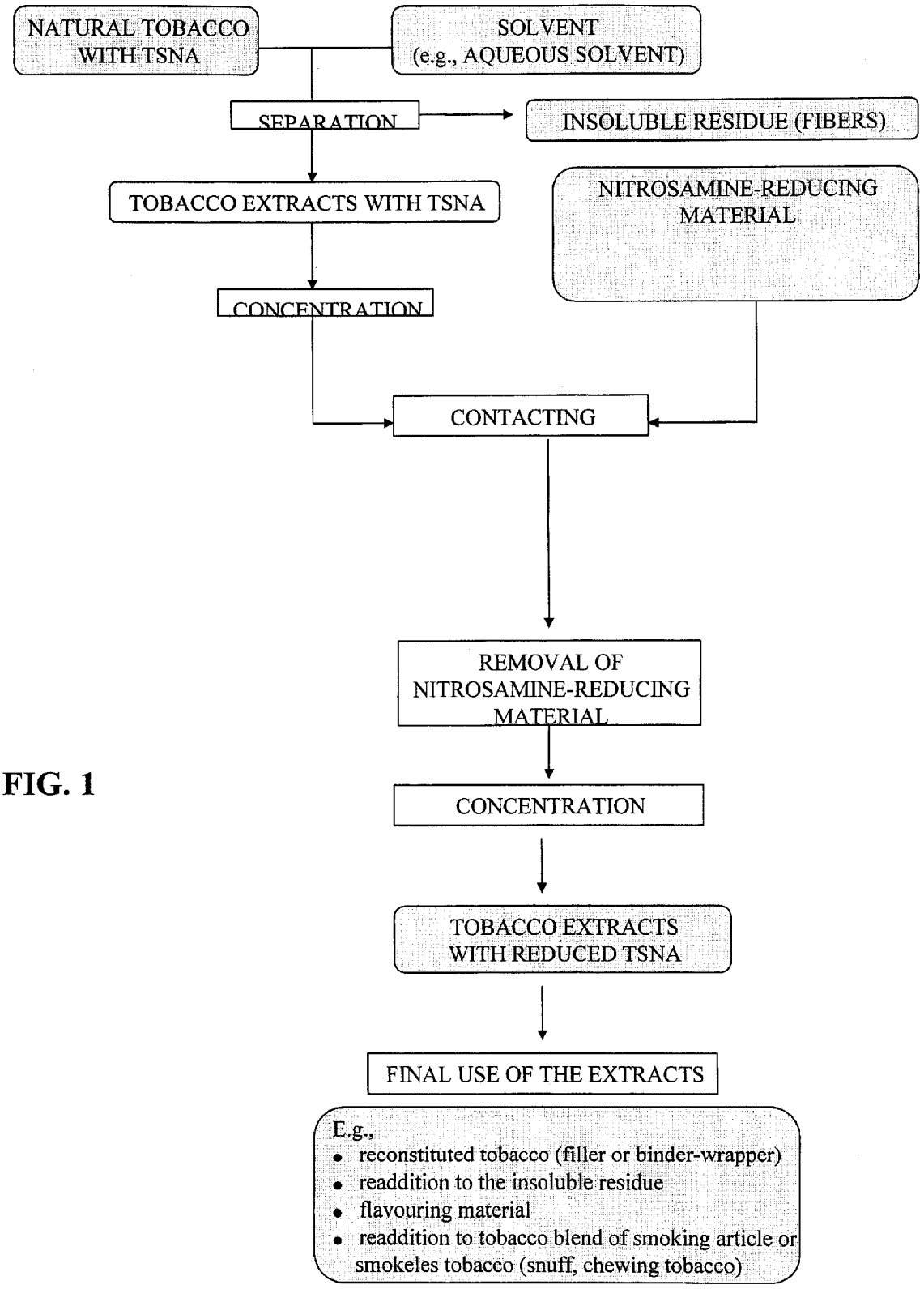
FIG. 1 is a schematic diagram of one embodiment of a method of the present invention for reducing the nitrosamine content of tobacco.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations and their equivalents.

In general, the present invention is directed to a method for reducing the presence of nitrosamines, such as tobacco-specific nitrosamines (TSNAs), in tobacco. As used herein, the term "tobacco" is meant to encompass natural tobacco (e.g. tobacco stems, such as flue-cured stems, fines, tobacco byproducts), reconstituted tobacco, tobacco extracts, blends thereof, and other tobacco-containing materials. In some embodiments, the nitrosamine-reducing material can be selected from the group consisting of charcoal, activated charcoal, zeolite, sepiolite, and the like, and can be utilized to reduce the nitrosamine content of tobacco.

The nitrosamine-reducing material generally has an affinity for nitrosamines such that the resulting content of the nitrosamine in tobacco can be reduced. For instance, without intending to be limited by theory, it is believed that, in some embodiments, the nitrosamine-reducing material "adsorbs" nitrosamines. As used herein, the term "adsorb" generally refers to the retention of solid, liquid or gas molecules or atoms on the surface of a solid or liquid. Moreover, in some instances, the nitrosamine-reducing material may also "absorb" nitrosamines. As used herein, the term "absorb" generally refers to the extraction of solid, liquid, or gas molecules or atoms into the bulk of a material when contacted therewith.

The nitrosamine-reducing material may also possess other characteristics that enable it to enhance the ability of the material to reduce the content of nitrosamines in tobacco. For example, the nitrosamine-reducing material can possess a certain surface area, mean pore/channel size, etc. In some embodiments, for instance, the nitrosamine-reducing material can have a surface area of greater than about 600 square meters per gram, and in some embodiments, greater than about 1000 square meters per gram. Further, the nitrosamine-reducing material may also include pores/channels that have a mean diameter larger than about 3.5 angstroms, in some embodiments larger than about 7 angstroms, and in some embodiments, between about 7 angstroms to about 100 angstroms.

Any material capable of reducing nitrosamine content may generally be utilized in the present invention. For example, activated charcoal can be utilized as the nitrosamine-reducing material. Some suitable types of activated charcoal include, but are not limited to, wood activated charcoal, coconut activated charcoal, activated charcoal cloth (e.g., Activated Charcoal Cloth obtained from Chemviron Carbon, Ltd., England), and the like. In addition, other nitrosamine-reducing materials may also be utilized. For example, in some embodiments, a zeolite can be utilized. In one embodiment, for instance, a hydrophobic zeolite can be utilized that has the following general formula:

$$M_m M'_n M''_p[aAlO_2.bSiO_2.cTO_2]Q_r$$

wherein,

M is a monovalent cation,

M' is a divalent cation,

M" is a trivalent cation, c, m, n, p, and r are greater than or equal to 0, a, b are greater than or equal to 1, T is a tetrahedrally coordinated metal atom, and Q is a sorbate molecule corresponding to the pore geometry of the zeolite.

Moreover, if desired, sepiolites may also be utilized as the nitrosamine-reducing material. A sepiolite is a hydrated magnesium silicate that belongs to the phyllosilicate group. In one embodiment, for example, a sepiolite having zeolitic channels between about 3.6 angstroms to about 10.6 angstroms may be particularly well suited in the present invention, and can have the following formula:

$$Si_{12}Mg_8O_{30}(OH)_4(OH_2)_4.8H_2O$$

Regardless of the particular nitrosamine-reducing material selected, it can generally be utilized in a variety of different ways to reduce the nitrosamine content of tobacco. In particular, the present inventors have discovered that enhanced removal of nitrosamines can be accomplished by contacting a nitrosamine-reducing material with a tobacco solution.

For example, referring to FIG. 1, one embodiment of a method for removing nitrosamines from tobacco will now be described in more detail. As shown, a tobacco furnish containing tobacco stems (e.g., flue-cured stems), fines and/or other tobacco by-products from tobacco manufacturing processes is initially mixed with a solvent (e.g., water and/or other compounds). For example, various solvents that are water-miscible, such as alcohols (e.g., ethanol), can be combined with water to form an aqueous solvent. The water content of the aqueous solvent can, in some instances, be greater than 50% by weight of the solvent, and particularly greater than 90% by weight of the solvent. Deionized water, distilled water or tap water may be employed. The amount of the solvent in the suspension can vary widely, but is generally added in an amount from about 75% to about 99% by weight of the suspension. However, the amount of solvent can vary with the nature of the solvent, the temperature at which the extraction is to be carried out, and the type of tobacco furnish.

After forming the solvent/tobacco furnish mixture, some or all of a soluble portion of the furnish mixture may be optionally separated (e.g., extracted) from the mixture. If desired, the aqueous solvent/tobacco furnish mixture can be agitated during extraction by stirring, shaking or otherwise mixing the mixture in order to increase the rate of extraction. Typically, extraction is carried out for about one-half hour to about 6 hours. Moreover, although not required, typical extraction temperatures range from about 10° C. to about 100° C.

Once extracted, the insoluble, solids portion can optionally be subjected to one or more mechanical refiners to produce a fibrous pulp. Some examples of suitable refiners can include disc refiners, conical refiners, and the like. The pulp from the refiner can then be transferred to a papermaking station (not shown) that includes a forming apparatus, which may include, for example, a forming wire, gravity drain, suction drain, felt press, Yankee dryer, drum dryers, etc. In such a forming apparatus, the pulp is laid onto a wire belt forming a sheet-like shape and excess water is removed by the gravity drain and suction drain and presses. Once separated from the insoluble portion of the tobacco solution, the soluble portion can optionally be concentrated using any known type of concentrator, such as a vacuum evaporator.

The soluble portion can then be contacted with a nitrosamine-reducing material for removing nitrosamines therefrom. For example, in one embodiment of the present invention, as shown in FIG. 1, the nitrosamine-reducing material is directly mixed with the soluble portion (e.g., aqueous extract). As a result, nitrosamines within the soluble portion can be removed and readily retained by the nitrosamine-reducing material. In general, any effective amount of nitrosamine-reducing material can be utilized. For instance, in one embodiment, the soluble portion can be combined with a nitrosamine-reducing material such that it is present in an amount greater than about 0.5% by weight of the solution, in some embodiments, between about 0.5% to about 50% by weight of the solution, and in some embodiments, between about 5% to about 50% by weight of the solution.

Other techniques for contacting the soluble portion with the nitrosamine-reducing material can also be utilized. For example, in one embodiment, the soluble portion can be filtered through a charcoal filter. Moreover, in another embodiment, the soluble portion can be conveyed over a charcoal bed, cartridge, or cloth. It should be understood, however, that any other suitable technique for contacting the nitrosamine-reducing material with the soluble portion may also be utilized in accordance with the present invention.

Referring again to FIG. 1, after being mixed with the soluble portion, the nitrosamine-reducing material may then be optionally removed therefrom. For example, the nitrosamine-reducing material can be removed from the soluble portion utilizing well-known techniques, such as centrifugation, decantation, filtration, etc. Thereafter, the nitrosamine-reducing material can be transferred to a waste disposal station (not shown) or recycled for the further removal of nitrosamines.

After contacting the soluble portion with the nitrosamine-reducing material, using techniques such as described above, the soluble portion can optionally be concentrated. Moreover, the concentrated or unconcentrated soluble portion can be utilized in any manner desired. For example, in one embodiment, nitrosamine-reduced soluble portion can be used as a flavoring material for tobacco products.

In other embodiments, the soluble portion can be recombined with the web to form reconstituted tobacco (filler or binder-wrapper). Specifically, the nitrosamine-reduced soluble portion can be reapplied to the sheet, tobacco blend, insoluble residue, etc., using various application methods, such as spraying, using sizing rollers, saturating, and the like. Reconstituted tobacco can generally be formed in a variety of ways. For instance, in one embodiment, band casting can be utilized to form the reconstituted tobacco. Band casting typically employs a slurry of finely divided tobacco parts and a binder that is coated onto a steel band and then dried. After drying, the sheet is blended with natural tobacco strips or shredded and used in various tobacco products, including as a cigarette filler. Some examples of process for producing reconstituted tobacco are described in U.S. Pat. Nos. 3,353,541; 3,420,241; 3,386,449; 3,760,815; and 4,674,519; which are incorporated herein in their entirety by reference thereto. Reconstituted tobacco can also be formed by a papermaking process. Some examples of processes for forming reconstituted tobacco according to this process are described in U.S. Pat. Nos. 3,428,053; 3,415,253; 3,561,451; 3,467,109; 3,483,874; 3,860,012; 3,847,164; 4,182,349; 5,715,844; 5,724,998; and 5,765,570; which are also incorporated herein in their entirety by reference thereto for all purposes. For example, the formation of reconstituted tobacco using papermaking techniques can involve the steps of mixing tobacco with water, extracting the soluble ingredients therefrom, concentrating the soluble ingredients, refining the tobacco, forming a web, reapplying the concentrated soluble ingredients, drying, and threshing.

In addition, various other ingredients, such as flavor or color treatments, can also be applied to the web. If applied with the soluble portion and/or other ingredients, the fibrous sheet material can, in some embodiments, then be dried using, for example, a tunnel dryer, to provide a sheet having a typical moisture content of less than 20% by weight, and particularly from about 9% to about 14% by weight. Subsequently, the sheet can be cut to a desired size and/or shape and dried to the desired final moisture content.

Figure 2:
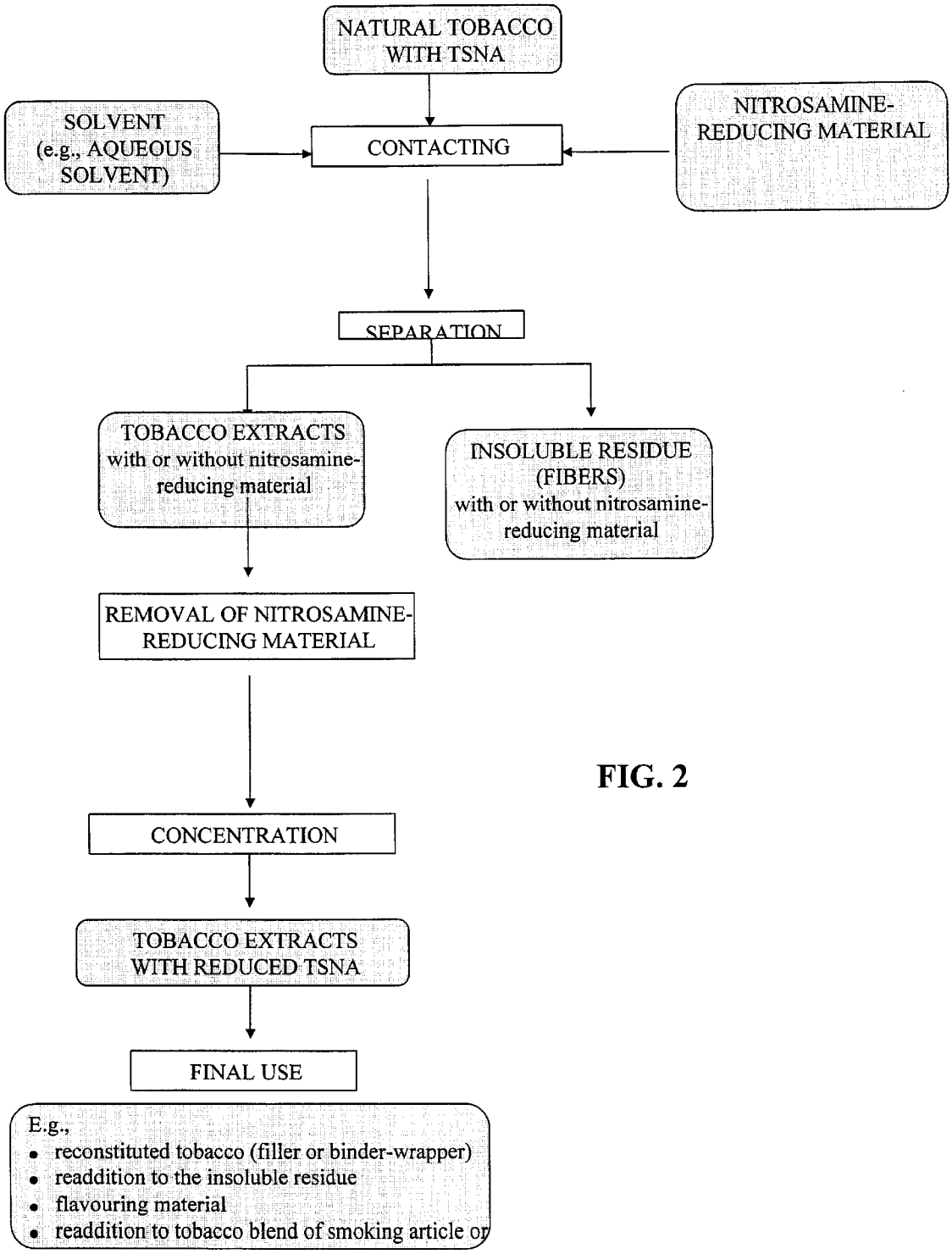
FIG. 2 is a schematic diagram of another embodiment of a method of the present invention for reducing the nitrosamine content of tobacco.

Referring to FIG. 2, another embodiment for removing nitrosamines from tobacco will now be described in more detail. Initially, a tobacco furnish containing tobacco stems (e.g., flue-cured stems), fines and/or other tobacco by-products from tobacco manufacturing processes can be placed into contact with a solvent, as described above, and a nitrosamine-reducing material for removing nitrosamines therefrom. In general, a variety of techniques can be utilized to remove the nitrosamines. For example, in one embodiment of the present invention, as shown in FIG. 2, a nitrosamine-reducing material can be directly mixed with the tobacco and solvent. As a result, nitrosamines within the soluble portion can be removed and readily retained by the nitrosamine-reducing material. Other suitable contacting techniques can also be used, including, but not limited to, contacting tobacco mixture with a cartridge or bed containing a nitrosamine-reducing material. The mixture is then separated and the nitrosamine-reducing material optionally removed, such as described above. The soluble and insoluble portions can also be utilized in a manner described above. Moreover, the soluble portion can be optionally concentrated using various well-known techniques.

Figure 3:
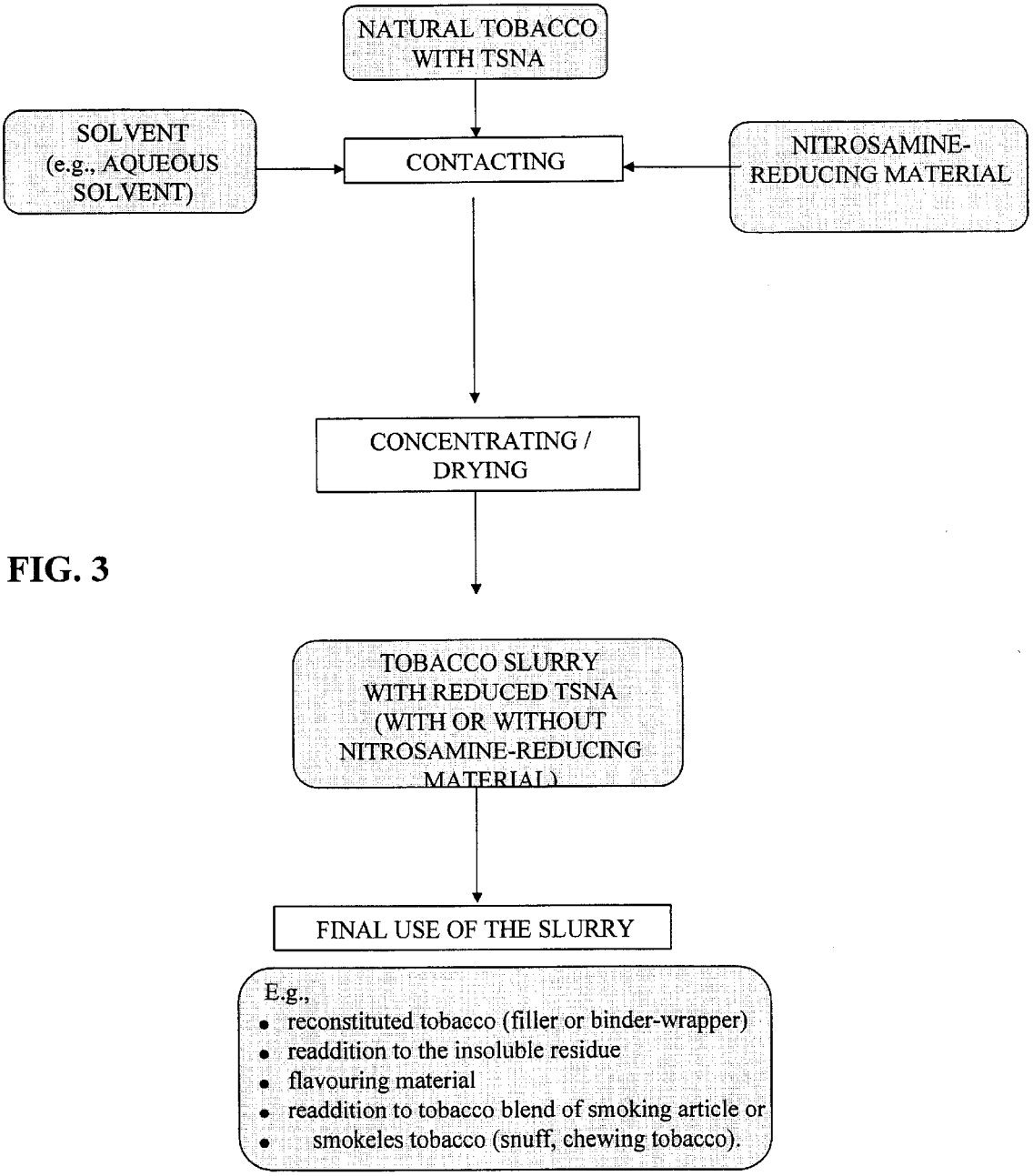
FIG. 3 is a schematic diagram of another embodiment of a method of the present invention for reducing the nitrosamine content of tobacco.

Referring to FIG. 3, after the tobacco is placed into contact with a nitrosamine-reducing material, such as shown in FIG. 2, the resulting mixture can, in some embodiments, then be optionally concentrated and/or dried. The resulting tobacco slurry mixture can possess a reduced nitrosamine content and can be used in a wide variety of applications, such as, for example, in snuff tobacco, in chewing tobacco, during reconstitution, etc.

Although various embodiments for contacting a nitrosamine-reducing material with tobacco have been described above, it should be understood that the nitrosamine-reducing material can generally be contacted with tobacco in any manner desired. For example, in some embodiments, the nitrosamine-reducing material can be added to a wet sheet as it is formed. It should also be understood that, if desired, more than one nitrosamine-reducing material can be utilized and that such material(s) can be applied at more than one stage of a process.

As a result of the present invention, it has been discovered that the nitrosamine content of tobacco can be selectively reduced. For instance, it has been discovered that the total content of nitrosamines, such as N'-Nitrosonornicotine (NNN), 4-(Methylnitrosamino)-1-(3-pyridyl)-1-butanone (NNK), N'-Nitrosoanatabine (NAT), and N'-Nitrosoanabasine (NAB) can be reduced at least about 20%, in some embodiments at least about 60%, and in some embodiments, between about 85% to about 100% from the initial total level when contacted with a nitrosamine-reducing material in accordance with the present invention. Moreover, in some embodiments, the resulting total tobacco-specific nitrosamine level can be less than about 300 nanograms per gram of the soluble portion, and in some embodiments, less than about 40 nanograms per gram of the soluble portion.

In addition, significantly improved tobacco products may be formed therefrom from tobacco in accordance with the present invention. As used herein, the term "tobacco product" is meant to encompass smoking articles (e.g., cigarettes, cigars, fine cut smoking articles, pipes, etc.), smokeless articles (e.g., chewing tobacco, snuff, etc.), tobacco additives (e.g., for use as flavorants, etc.), and the like. For example, when the soluble portion having a reduced level of nitrosamines is incorporated into a smoking article, smoke produced by the smoking article can also contain a lower content of nitrosamines.

Besides being capable of reducing the nitrosamine content of tobacco, it has also been surprisingly discovered that the nitrosamine-reducing material is capable of reducing the presence of other compounds found within many tobacco products. For instance, in some embodiments, the nitrosamine-reducing material has been found to reduce the level of alkaloids in tobacco at least about 10%, in some embodiments between about 25% to about 95%, and in some embodiments, between about 60% to about 95% at from the initial total content. Because alkaloids typically contain around 90–95% nicotine, such a reduction may often be desired to reduce such levels according to the present invention.

The present invention may be better understood with reference to the following examples:

EXAMPLE 1

The ability of activated charcoal to reduce the presence of nitrosamines in reconstituted tobacco was demonstrated. Flue-cured stems were initially tested for the content of NNN, NNK, NAT, and NAB. The results are given below in Table 1.

TABLE 1

Flue-Cured Stems Nitrosamine Content

| Nitrosamine Tested | Content (μgrams/gram of flue-cured stem) |
|---|---|
| NNN | 1.67 |
| NNK | 1.69 |
| NAT | 0.53 |
| NAB | 0.13 |
| Total | 4.02 |

Note: Results obtained between the detection limit (0.05 micrograms per gram) and a determination limit (0.2 micrograms per gram) were reported as "0.13" micrograms based on the potential unreliability of such values.

Thereafter, activated charcoal and pulp were combined with the flue-cured stems and formed into a web according to a papermaking process, such as described above. The resulting reconstituted tobacco sheet contained 59% flue-cured stems, 12% wood pulp fibers, and 29% activated charcoal.

After forming the web, it was then tested for nitrosamine content (i.e., NNN, NNK, NAT, and NAB). The expected total content was 2.62 μgrams/gram of reconstituted tobacco (e.g., 1.12 μgrams NNN/gram of reconstituted tobacco). However, when tested, the detected amount of each nitrosamine was between the detection limit for powders and tobacco samples (0.05 micrograms per gram) and the determination limit for powders and tobacco samples (0.2 micrograms per gram). Although values within this range were potentially unreliable, the total nitrosamine content was at least less than 0.8 micrograms per gram (based on a determination limit of 0.2 micrograms per gram for each nitrosamine). Thus, as indicated, the total level of nitrosamines in the tobacco can be selectively reduced.

EXAMPLE 2

A blend of tobacco stems and scraps (flue-cured, burley, oriental) was contacted with tap water at 65° C. for one hour. After stirring, the insoluble fraction was then separated from the soluble fraction by pressing. The soluble fraction had a dry matter content of 8.6%, i.e., the dry matter represented 8.6% by weight of the soluble fraction.

Coconut activated charcoal having a surface area of 1150 $m^2/g$ and a mean diameter of 21 μm was then added to the solution at a level of 30% of the dry matter content. Thereafter, the solution was stirred for one hour and then centrifuged for 6 minutes at 6000 revolutions per minute with a centrifugal acceleration of 3400 g in order to remove the activated charcoal and the remaining suspended solids. The dry matter content of the solution after centrifugation was determined to be 8.0%.

The total TSNA content of the soluble fraction, without any addition of activated charcoal and after centrifugation, was 611 nanograms per gram of solution. After centrifugation, no nitrosamines were detected in the soluble fraction with addition of activated charcoal, thus indicating that the total nitrosamine content was at least lower 40 nanograms per gram of tobacco (10 nanograms per gram was the lowest detectable limit of the above-listed nitrosamines for liquid samples).

The alkaloids content was also reduced as shown in the Table 2 below:

TABLE 2

Properties of Soluble Fractions

| | TSNA (ng/g solution) | | | | | (% of dry matter content) | | |
|---|---|---|---|---|---|---|---|---|
| | NNN | NAT | NNB | NNK | Total | Alkaloids | Reducing sugars | Nitrates |
| Control soluble fraction | 342 | 145 | 18 | 106 | 611 | 1.55 | 23.0 | 3.3 |
| Treated soluble fraction | <10 | <10 | <10 | <10 | <40 | 0.39 | 28.4 | 4.1 |

Note: Results obtained between the detection limit (10 nanograms per gram) and a determination limit (25 nanograms per gram) were reported as "18" nanograms based on the potential unreliability of such values.
Note: Results reported as "<10" indicated that the nitrosamine content was not detected (10 nanograms per gram was the lowest detectable limit of liquid samples).

Thus, as indicated, the total level of nitrosamines and alkaloids in the tobacco can be selectively reduced without substantially reducing other levels of components in the tobacco, such as nitrates and reducing sugars.

EXAMPLE 3

Dark air cured tobacco stems having a total TSNA content of 0.84 micrograms per gram of dry tobacco were chopped and mixed with tap water (5 parts of water and 1 parts of tobacco) at 65° C. After 20 minutes of total contact, the insoluble fraction was separated from the soluble fraction by pressing. The soluble fraction had a dry matter content of 4.2%.

The same activated charcoal as in Example 2 was then added to the solution at a rate of 30% of the dry matter content. Thereafter, the solution was stirred for one hour at 350 revolutions per minute and then centrifuged for 6 minutes at 6000 revolutions per minute in order to remove the activated charcoal and the remaining suspended solids. The dry matter content of the solution after centrifugation was 4.0%.

The total TSNA content of the soluble fraction, without any addition of activated charcoal and after centrifugation, was 121 nanograms per gram of solution. After centrifugation, no nitrosamines were detected in the soluble fraction with addition of activated charcoal, thus indicating that the total nitrosamine content was at least lower 40 nanograms per gram of tobacco (10 nanograms per gram was the lowest detectable limit of the above-listed nitrosamines for liquid samples).

The alkaloids content was also reduced as shown in Table 3 below:

TABLE 3

Properties of Soluble Fractions

| | TSNA (ng/g solution) | | | | | (% of dry matter content) | | |
|---|---|---|---|---|---|---|---|---|
| | NNN | NAT | NNB | NNK | Total | Alkaloids | Reducing sugars | Nitrates |
| Control soluble fraction | 76 | 18 | <10 | 27 | 121 | 1.79 | 10.7 | 6.7 |
| Treated soluble fraction | <10 | <10 | <10 | <10 | <40 | 0.25 | 11.0 | 7.9 |

Note: Results obtained between the detection limit (10 nanograms per gram) and a determination limit (25 nanograms per gram) were reported as "18" nanograms based on the potential unreliability of such values.
Note: Results reported as "<10" indicated that the nitrosamine content was not detected (10 nanograms per gram was the lowest detectable limit of liquid samples).

Thus, as indicated, the total level of nitrosamines in the tobacco can be selectively reduced without substantially reducing other levels of components in the tobacco, such as nitrates and reducing sugars.

EXAMPLE 4

Dark air cured tobacco stems having a total TSNA content of 14.9 micrograms per gram of dry tobacco were chopped and mixed with tap water (5 parts of water and 1 part of tobacco) at 65° C. After 20 minutes of total contact, the insoluble fraction was separated from the soluble fraction by pressing. The soluble fraction had a dry matter content of 4.1%.

The same activated charcoal as in Example 2 was added to the solution at a rate of 50% of the dry matter content. Thereafter, the solution was stirred for 1 hour at 350 revolutions per minute and then centrifuged for 6 minutes at 6000 revolutions per minute to remove the activated charcoal and the remaining suspended solids. Additionally, the solution was filtered through a fiberglass filter (Durieux No. 28) having a retention above 0.7 micrometers to remove any remaining suspended solids. The dry matter content of the solution after centrifugation and filtration was 3.7%.

The total TSNA content of the soluble fraction without any addition of activated charcoal was 2039 nanograms per gram of solution. After centrifugation and filtration, the total nitrosamine content was at least lower than 80 nanograms per gram of tobacco (10 nanograms per gram was the lowest detectable limit of the above-listed nitrosamines for liquid samples).

Tobacco alkaloids were also reduced as shown in Table 4 below:

TABLE 4

Properties of Soluble Fractions

| | TSNA (ng/g solution) | | | | | (% of dry matter content) | | |
|---|---|---|---|---|---|---|---|---|
| | NNN | NAT | NNB | NNK | Total | Alkaloids | Reducing sugars | Nitrates |
| Control soluble fraction | 1167 | 366 | 43 | 463 | 2039 | 2.64 | 1.9 | 9.7 |
| Treated soluble fraction | 42 | 18 | <10 | <10 | <80 | 0.41 | 1.1 | 10.9 |

Note: Results obtained between the detection limit (10 nanograms per gram) and a determination limit (25 nanograms per gram) were reported as "18" nanograms based on the potential unreliability of such values.
Note: Results reported as "<10" indicated that the nitrosamine content was not detected (10 nanograms per gram of solution was the lowest detectable limit of liquid samples).

Thus, as indicated, the total level of nitrosamines in the tobacco can be selectively reduced without substantially reducing other levels of components in the tobacco, such as nitrates and reducing sugars.

EXAMPLE 5

A blend of tobacco stems and scraps (flue-cured, burley, oriental) was contacted with tap water at 65° C. for one hour. After stirring, the insoluble fraction was then separated from the soluble fraction by pressing. The soluble fraction had a dry matter content of 8.9%.

Activated charcoal, as described in Example 2, was then added to the solution at a rate of 50% of the dry matter content. Thereafter, the solution was stirred for one hour at 350 revolutions per minute and then centrifuged for 6 minutes at 6000 revolutions per minute in order to remove the activated charcoal and the remaining suspended solids. Additionally, the solution was filtered through a fiberglass filter (Durieux No. 28) having a retention above 0.7 micrometers to remove any remaining suspended solids. The dry matter content of the solution after centrifugation and filtration was determined to be 7.0%.

The total TSNA content of the soluble fraction, without any addition of activated charcoal and after centrifugation and filtration, was 678 nanograms per gram of solution. After centrifugation and filtration, no nitrosamines were detected in the soluble fraction with addition of activated charcoal, thus indicating that the total nitrosamine content was at least lower 40 nanograms per gram of tobacco (10 nanograms per gram was the lowest detectable limit of the above-listed nitrosamines for liquid samples).

Tobacco alkaloids were also reduced as shown in Table 5 below:

TABLE 5

Properties of Soluble Fractions

| | TSNA (ng/g solution) | | | | | (% of dry matter content) | | |
|---|---|---|---|---|---|---|---|---|
| | NNN | NAT | NNB | NNK | Total | Alkaloids | Reducing sugars | Nitrates |
| Control soluble fraction | 315 | 221 | 18 | 124 | 678 | 1.36 | 19.5 | 2.7 |
| Treated soluble fraction | <10 | <10 | <10 | <10 | <40 | 0.23 | 17.2 | 2.8 |

Note: Results obtained between the detection limit (10 nanograms per gram) and a determination limit (25 nanograms per gram) were reported as "18" nanograms based on the potential unreliability of such values.
Note: Results reported as "<10" indicated that the nitrosamine content was not detected (10 nanograms per gram of solution was the lowest detectable limit of liquid samples).

Thus, as indicated, the total level of nitrosamines in the tobacco can be selectively reduced without substantially reducing other levels of components in the tobacco, such as nitrates and reducing sugars.

EXAMPLE 6

Dark air cured tobacco stems having a TSNA content of 14.9 micrograms per gram of dry tobacco were chopped and mixed with tap water (10 parts of water and 1 parts of tobacco) at 60° C. After 30 minutes of total contact, the insoluble fraction was separated from the soluble fraction by pressing. The soluble fraction had a dry matter content of 3.7%

The same activated charcoal as Example 2 was then added to the solution at a rate of 30% of the dry matter content. Thereafter, the solution was stirred for one hour at 350 revolutions per minute and then centrifuged for 6 minutes at 6000 revolutions per minute to remove the activated charcoal and the remaining suspended solids. Additionally, the solution was filtered through a fiberglass filter (Durieux No. 28) having a retention above 0.7 micrometers to remove any remaining suspended solids. The solution was then concentrated under vacuum up to 30% dry matter content.

In parallel, the insoluble fraction was refined for 30 minutes. After dilution of the refined fibers into water, paper webs were formed on a laboratory paper former. Afterwards, the webs were impregnated with the concentrated solution so that the finished reconstituted tobacco had a substance weight of 104 g/m$^2$ (bone dry) and contained 22% by weight (bone dry) of the soluble fraction.

As indicated below in Table 6, the reconstituted tobacco treated with activated charcoal showed reduced total TSNA and alkaloids compared to the control reconstituted tobacco (no treatment).

TABLE 6

Properties of Soluble Fractions

| | TSNA (micrograms per gram) | | | | | (% of dry matter content) | | |
|---|---|---|---|---|---|---|---|---|
| | NNN | NAT | NNB | NNK | Total | Alkaloids | Reducing sugars | Nitrates |
| Control reconst. tobacco | 6.46 | 2.02 | 0.22 | 2.85 | 11.55 | 0.58 | 0.7 | 2.25 |

TABLE 6-continued

Properties of Soluble Fractions

| | TSNA (micrograms per gram) | | | | | (% of dry matter content) | | |
|---|---|---|---|---|---|---|---|---|
| | NNN | NAT | NNB | NNK | Total | Alkaloids | Reducing sugars | Nitrates |
| Treated reconst. tobacco | 0.76 | 0.13 | <.05 | 0.25 | <1.19 | 0.20 | 0.6 | 2.21 |

Note: Results obtained between the detection limit (0.05 micrograms per gram) and a determination limit (0.2 micrograms per gram) were reported as "0.13" micrograms based on the potential unreliability of such values.
Note: Results reported as "<0.05" indicated that the nitrosamine content was not detected (0.05 micrograms per gram was the lowest detectable limit of powders and tobacco samples).

Thus, as indicated, the total level of nitrosamines in the tobacco can be selectively reduced without substantially reducing other levels of components in the tobacco, such as nitrates and reducing sugars.

EXAMPLE 7

A blend of Burley leaves and stems having a mean TSNA content of 7.6 micrograms per gram of dry tobacco was contacted with tap water at 65° C. (9 parts of water and 1 part of tobacco). After 30 minutes of total contact, the insoluble fraction was then separated from the soluble fraction by pressing. The soluble fraction had a dry matter content of 4.8%.

Various types of activated charcoal were then contacted with the above soluble fraction. The solution was stirred for one hour at 350 revolutions per minute. The level of activated charcoal was also varied as shown in Table 7 below:

TABLE 7

Activated Charcoal Properties

| Activated charcoal features | | | | Rate of introduction |
|---|---|---|---|---|
| Sample No. | Type | Mean diameter (μm) | Surface area (m$^2$/g) | in the soluble fraction (% of dry matter) |
| 1 | — | — | — | 0 |
| 2 | Coco | 115 | 1071 | 30 |
| 3 | Coco | 115 | 1071 | 60 |
| 4 | Coco | 115 | 1071 | 100 |
| 5 | Coco | 21 | 1150 | 30 |
| 6 | Coco | 595 | 600 | 30 |
| 7 | Wood | 24 | 1150 | 30 |

As in the examples above, activated charcoal and suspended solids were removed by centrifugation. Additionally, the solution was filtered through a fiberglass filter (Durieux No. 28) having a retention above 0.7 micrometers to remove any remaining suspended solids. The dry matter content of the solutions after centrifugation and filtration is given in Table 8 below.

In addition, as shown in Table 8, the total TSNA and alkaloids content were also reduced.

TABLE 8

| Sample No. | Dry matter content of solution[1] (%) | Properties of Solutions: TSNA (ng/g solution) NNN | NAT | NAB | NNK | Total | Alkaloids (% of dry matter content) | Reducing sugars (% of dry matter content) | Nitrates (% of dry matter content) |
|---|---|---|---|---|---|---|---|---|---|
| 1 | 4.8 | 625 | 295 | 18 | 81 | 1019 | 7.79 | 4.9 | 13.3 |
| 2 | 4.5 | 104 | 34 | <10 | <10 | <158 | 4.82 | 4.1 | 13.9 |
| 3 | 4.1 | 18 | 18 | <10 | <10 | <56 | 5.35 | 3.9 | 15.4 |
| 4 | 3.9 | <10 | <10 | <10 | <10 | <40 | 0.78 | 3.5 | 14.3 |
| 5 | 3.8 | 48 | 18 | <10 | <10 | <86 | 5.77 | 4.5 | 16.2 |
| 6 | 4.1 | 230 | 82 | <10 | <10 | <332 | 5.33 | 3.2 | 14.0 |
| 7 | 3.9 | 84 | 49 | <10 | <10 | <153 | 4.98 | 2.6 | 15.7 |

[1]After centrifugation and filtration

Note: Results obtained between the detection limit (10 nanograms per gram) and a determination limit (25 nanograms per gram) were reported as "18" nanograms based on the potential unreliability of such values.

Note: Results reported as "<10" indicated that the nitrosamine content was not detected (10 nanograms per gram of solution was the lowest detectable limit of liquid samples).

Thus, as indicated, the total level of nitrosamines in the tobacco can be selectively reduced without substantially reducing other levels of components in the tobacco, such as nitrates and reducing sugars.

EXAMPLE 8

Dark air cured tobacco stems having a total TSNA content of 9.6 micrograms per gram of dry tobacco were chopped and mixed with tap water (9 parts of water and 1 part of tobacco) at 65° C. After 30 minutes of total contact, the insoluble fraction was separated from the soluble fraction by pressing. The soluble fraction had a dry matter content of 5.1%.

515 $cm^2$ of Activated Charcoal Cloth FMI/250 from Charcoal Cloth International, a division of Chemviron Carbon Ltd, was introduced in an Erlenmeyer flask. The Charcoal Cloth had an internal surface area of 1050–1400 $m^2/g$ composed entirely of micropores and a substance weight of 134 $g/m^2$. 500 ml of the tobacco soluble fraction was poured into the Erlenmeyer flask, which was then placed on an orbital shaker for one hour.

The soluble fraction was then separated from the Charcoal Cloth and centrifuged for 6 minutes at 6000 revolutions per minute to remove any residual fibers of the Charcoal Cloth and suspended solids. Additionally, the solution was filtered through a fiberglass filter (Durieux No. 28) having a retention above 0.7 micrometers to remove any remaining suspended solids. After centrifugation and filtration, the solution had a dry matter content of 4.8%.

As shown below in Table 9, the use of the Charcoal Cloth resulted in a significant reduction of total TSNA and alkaloid content.

TABLE 9

| | Properties of Soluble Fractions: TSNA (ng/g solution) NNN | NAT | NNB | NNK | Total | Alkaloids (% of dry matter content) | Reducing sugars (% of dry matter content) | Nitrates (% of dry matter content) |
|---|---|---|---|---|---|---|---|---|
| Control soluble fraction | 493 | 211 | <10 | 66 | <780 | 1.55 | 5.8 | 12.5 |

TABLE 9-continued

| | Properties of Soluble Fractions: TSNA (ng/g solution) NNN | NAT | NNB | NNK | Total | Alkaloids (% of dry matter content) | Reducing sugars (% of dry matter content) | Nitrates (% of dry matter content) |
|---|---|---|---|---|---|---|---|---|
| Treated soluble fraction | 200 | 85 | <10 | <10 | <305 | 1.39 | 5.7 | 12.1 |

Note: Results reported as "<10" indicated that the nitrosamine content was not detected (10 nanograms per gram of solution was the lowest detectable limit of liquid samples).

Thus, as indicated, the total level of nitrosamines in the tobacco can be selectively reduced without substantially reducing other levels of components in the tobacco, such as nitrates and reducing sugars.

EXAMPLE 9

Dark air cured tobacco stems having a total TSNA content of 9.6 micrograms per gram of dry tobacco were chopped and mixed with tap water (9 parts of water and 1 part of tobacco) at 65° C. After 30 minutes of total contact, the insoluble fraction was separated from the soluble fraction by pressing. The soluble fraction had a dry matter content of 5.1%. The Si/Al ratio of the zeolite was about 100 and its pore/channel size was 8 angstroms.

The zeolite was added to the tobacco soluble fraction at a rate of 100% of the dry matter content. Thereafter, the solution was stirred for one hour at 350 revolutions per minute and then centrifuged for 6 minutes at 6000 revolutions per minute to remove the zeolite and the remaining suspended solids. Additionally, the solution was filtered through a fiberglass filter (Durieux No. 28) having a retention above 0.7 micrometers to remove any remaining suspended solids. The centrifugated and filtrated solution had a dry matter content of 4.9%.

The total TSNA content of the soluble fraction without addition of activated charcoal was less than 780 nanograms per gram of solution. After centrifugation and filtration, no nitrosamines were detected in the soluble fraction with addition of zeolite, thus indicating that the total nitrosamine content was at least lower 40 nanograms per gram of tobacco (10 nanograms per gram was the lowest detectable limit of the above-listed nitrosamines for liquid samples).

Tobacco alkaloids were also removed as shown below in Table 10.

TABLE 10

Properties of Soluble Fractions

| | TSNA (ng/g solution) | | | | | (% of dry matter content) | | |
|---|---|---|---|---|---|---|---|---|
| | NNN | NAT | NNB | NNK | Total | Alkaloids | Reducing sugars | Nitrates |
| Control soluble fraction | 493 | 211 | <10 | 66 | <780 | 1.55 | 5.8 | 12.5 |
| Treated soluble fraction | <10 | <10 | <10 | <10 | <40 | 0.42 | 5.7 | 13.4 |

Note: Results reported as "<10" indicated that the nitrosamine content was not detected (10 nanograms per gram of solution was the lowest detectable limit of liquid samples).

Thus, as indicated, the total level of nitrosamines in the tobacco can be selectively reduced without substantially reducing other levels of components in the tobacco, such as nitrates and reducing sugars.

EXAMPLE 10

The same tobacco soluble fraction as described in Example 9 was utilized, except that a clay rich in sepiolite was used.

A blend of 50% Pansil 100 and 50% Pansil 400 from Grupo Tolsa was selected to reduce TSNA in the soluble fraction. Both Pansil 100 and Pansil 400 contain 60% sepiolite and 40% other clays. They differ in their particle size, Pansil 400 being finer than Pansil 100.

The blend of Pansil was added to the tobacco solution fraction at a rate of 100% of the dry matter content. Thereafter, the solution was stirred for one hour at 350 revolutions per minute and then centrifuged for 6 minutes at 6000 revolutions per minute to remove the Pansil clay and the remaining suspended solids. Additionally, the solution was filtered through a fiberglass filter (Durieux No. 28) having a retention above 0.7 micrometers to remove any remaining suspended solids. The centrifugated and filtrated solution had a dry matter content of 5.3%.

The total TSNA content of the soluble fraction, with addition of Pansil/sepiolite and after centrifugation and filtration, was 305 nanograms per gram, which was a significant reduction over the non-treated solution (less than 780 nanograms per gram as set forth in Example 9).

Although various embodiments of the invention have been described using specific terms, devices, and methods, such description is for illustrative purposes only. The words used are words of description rather than of limitation. It is to be understood that changes and variations may be made by those of ordinary skill in the art without departing from the spirit or scope of the present invention. In addition, it should be understood that aspects of the various embodiments may be interchanged both in whole or in part. Therefore, the spirit and scope of the invention should not be limited to the description of the preferred versions contained therein.

What is claimed is:

1. A method for reducing the content of nitrosamines in tobacco, said method comprising:

combining tobacco with an aqueous solvent to form a soluble portion, said soluble portion containing an initial total level of tobacco-specific nitrosamines per gram of said soluble portion, said tobacco-specific nitrosamines being selected from the group consisting of N'-Nitrosonornicotine, 4-(Methylnitrosamino)-1-(3-pyridyl)-1-butanone, N'-Nitrosoanatabine, N'-Nitrosoanabasine, and combinations thereof;

thereafter, contacting said soluble portion with a nitrosamine-reducing material such that the resulting total level of said tobacco-specific nitrosamines per gram of said soluble portion is at least about 20% less than said initial total level of said tobacco-specific nitrosamines per gram of said soluble portion, said nitrosamine-reducing material including an absorbent, adsorbent, or combinations thereof; and optionally, incorporating said soluble portion with a reduced level of said tobacco-specific nitrosamines into a tobacco product.

2. A method as defined in claim 1, wherein said nitrosamine-reducing material is an adsorbent.

3. A method as defined in claim 1, wherein said nitrosamine-reducing material is an absorbent.

4. A method as defined in claim 1, wherein said nitrosamine-reducing material is selected from the group consisting of charcoal, activated charcoal, zeolite, sepiolite, and combinations thereof.

5. A method as defined in claim 1, wherein said nitrosamine-reducing material is activated charcoal.

6. A method as defined in claim 1, wherein said nitrosamine-reducing material is zeolite.

7. A method as defined in claim 6, wherein said zeolite has the following formula:

$$M_m M'_n M''_p[aAlO_2.bSiO_2.cTO_2]Q_r$$

wherein,

M is a monovalent cation,

M' is a divalent cation,

M" is a trivalent cation, c, m, n, p, and r are greater than or equal to 0, a, b are greater than or equal to 1, T is a tetrahedrally coordinated metal atom, and Q is a sorbate molecule corresponding to the pore geometry of the zeolite.

8. A method as defined in claim 1, wherein said nitrosamine-reducing material is sepiolite.

9. A method as defined in claim 8, wherein said sepiolite has the following formula:

$$Si_{12}Mg_6O_{30}(OH)_4(OH_2)_4.8H_2O.$$

10. A method as defined in 1, wherein said nitrosamine-reducing material has a surface area greater than about 600 square meters per gram.

11. A method as defined in claim 1, wherein said nitrosamine-reducing material has a surface area greater than about 1000 square meters per gram.

12. A method as defined in 1, wherein said nitrosamine-reducing material includes pores, channels, or combinations thereof that have a mean diameter larger than about 3.5 angstroms.

13. A method as defined in claim 1, wherein said nitrosamine-reducing material includes pores, channels, or combinations thereof that have a mean diameter larger than about 7 angstroms.

14. A method as defined in claim 1, wherein said nitrosamine-reducing material is mixed with said soluble portion.

15. A method as defined in claim 14, wherein said nitrosamine-reducing material in removed from said soluble portion after being mixed therewith.

16. A method as defined in claim 1, wherein said soluble portion is filtered or conveyed through said nitrosamine-reducing material.

17. A method as defined in claim 1, further comprising separating an insoluble portion also formed from combining said solvent with said tobacco from said soluble portion prior to contacting said soluble portion with said nitrosamine-reducing material.

18. A method as defined in claim 17, further comprising recombining said soluble portion having a reduced level of said tobacco-specific nitrosamines with said insoluble portion.

19. A method as defined in claim 1, wherein the resulting total level of said tobacco-specific nitrosamines per gram of said soluble portion after being contacted with said nitrosamine-reducing material is at least about 60% less than said initial total level of said tobacco-specific nitrosamines per gram of said soluble portion.

20. A method as defined in claim 1, wherein the resulting total level of said tobacco-specific nitrosamines per gram of said soluble portion after being contacted with said nitrosamine-reducing material is between about 85% to about 100% less than said initial total level of said tobacco-specific nitrosamines per gram of said soluble portion.

21. A method as defined in claim 1, wherein the resulting total level of said tobacco-specific nitrosamines per gram of said soluble portion after being contacted with said nitrosamine-reducing material is less than about 300 nanograms per gram of said soluble portion.

22. A method as defined in claim 1, wherein the resulting total level of said tobacco-specific nitrosamines per gram of said soluble portion after being contacted with said nitrosamine-reducing material is less than about 40 nanograms per gram of said soluble portion.

23. A method as defined in claim 1, wherein said soluble portion also contains an initial total level of alkaloids per gram of said soluble portion, said initial total level of alkaloids being reduced at least about 10% after being contacted with said nitrosamine-reducing material.

24. A method as defined in claim 1, wherein said soluble portion also contains an initial total level of alkaloids per gram of said soluble fraction, said initial total level of alkaloids being reduced between about 25% to about 95% after being contacted with said nitrosamine-reducing material.

25. A method for reducing the content of nitrosamines in tobacco, said method comprising:

combining tobacco with an aqueous solvent to form an insoluble portion and a soluble portion, said soluble portion containing an initial total level of tobacco-specific nitrosamines per gram of said soluble portion, wherein said tobacco-specific nitrosamines are selected from the group consisting of N'-Nitrosonornicotine, 4-(Methylnitrosamino)-1-(3-pyridyl)-1-butanone, N'-Nitrosoanatabine, N'-Nitrosoanabasine, and combinations thereof;

thereafter, contacting said soluble portion with a nitrosamine-reducing material such that the resulting total level of said tobacco-specific nitrosamines per gram of said soluble portion is at least about 60% less than said initial total level of said tobacco-specific nitrosamines per gram of said soluble portion, said nitrosamine-reducing material being selected from the group consisting of charcoal, activated charcoal, zeolite, sepiolite, and combinations thereof, wherein said nitrosamine-reducing material includes pores, channels, or combinations thereof that have a mean diameter larger than about 3.5 angstroms; and optionally, incorporating said soluble portion with a reduced level of said tobacco-specific nitrosamines into a tobacco product.

26. A method as defined in claim 25, wherein said nitrosamine-reducing material is activated charcoal.

27. A method as defined in claim 25, wherein said nitrosamine-reducing material is zeolite.

28. A method as defined in claim 25, wherein said nitrosamine-reducing material is sepiolite.

29. A method as defined in claim 25, wherein said nitrosamine-reducing material includes pores, channels, or combinations thereof that have a mean diameter larger than about 7 angstroms.

30. A method as defined in claim 25, wherein the resulting total level of said tobacco-specific nitrosamines per gram of said soluble portion after being contacted with said nitrosamine-reducing material is between about 85% to about 100% less than said initial total level of said tobacco-specific nitrosamines per gram of said soluble portion.

31. A method as defined in claim 25, wherein the resulting total level of said tobacco-specific nitrosamines per gram of said soluble portion after being contacted with said nitrosamine-reducing material is less than about 40 nanograms per gram of said soluble portion.

32. A method as defined in 25, wherein said nitrosamine-reducing material has a surface area greater than about 600 square meters per gram.

33. A method as defined in claim 25, wherein said nitrosamine-reducing material has a surface area greater than about 1000 square meters per gram.

34. A method as defined in claim 25, wherein said nitrosamine-reducing material is mixed with said soluble portion.

35. A method as defined in claim 34, wherein said nitrosamine-reducing material in removed from said soluble portion after being mixed therewith.

36. A method as defined in claim 25, wherein said soluble portion is filtered or conveyed through said nitrosamine-reducing material.

37. A method as defined in claim 25, further comprising separating said insoluble portion from said soluble portion prior to contacting said soluble portion with said nitrosamine-reducing material.

38. A method as defined in claim 37, further comprising recombining said soluble portion having a reduced level of said tobacco-specific nitrosamines with said insoluble portion.

* * * * *